US005288026A

United States Patent [19]

Wilton

[11] Patent Number: 5,288,026

[45] Date of Patent: Feb. 22, 1994

[54] FLAME RETAINING CERAMIC BURNER NOZZLE

[76] Inventor: Paul V. Wilton, 2932 Via Loma Vista, Escondido, Calif. 92029

[21] Appl. No.: 35,402

[22] Filed: Mar. 22, 1993

[51] Int. Cl.[5] ..... B05B 1/14

[52] U.S. Cl. ..... 239/558; 239/548; 239/556; 239/DIG. 19

[58] Field of Search ..... 239/544, 548, 552, 556, 239/558, DIG. 19

[56] References Cited

U.S. PATENT DOCUMENTS

| | | | |
|---|---|---|---|
| 613,131 | 10/1898 | Feeron | 239/548 |
| 748,364 | 12/1903 | Gordon | 239/552 X |
| 1,498,644 | 6/1924 | Clark | 239/558 X |
| 1,968,978 | 8/1934 | White | 239/558 X |
| 3,697,000 | 10/1972 | Giberson . | |
| 4,969,815 | 11/1990 | Fukuda et al. . | |

FOREIGN PATENT DOCUMENTS

| | | | |
|---|---|---|---|
| 2374590 | 8/1978 | France | 239/558 |
| 86316 | 5/1983 | Japan | 239/DIG. 19 |
| 153613 | 7/1987 | Japan | 239/DIG. 19 |

*Primary Examiner*—Andres Kashnikow
*Assistant Examiner*—William Grant
*Attorney, Agent, or Firm*—Lewis E. Massie

[57] ABSTRACT

A gas burner nozzle made from tabular alumina mounted in a steel cup shaped support that operates at a high temperature and a high oxidation for use in fabricating glass products. The gas and fuel inlet ports terminating in a radiused exit that greatly reduces the noise common to devices of this sort. The burner has a cone shaped supplementary mixing chamber which, together with the improved gas and fuel exits and the reflecting ledge provides a smooth transition of the flame.

1 Claim, 1 Drawing Sheet

FLAME RETAINING CERAMIC BURNER NOZZLE

BACKGROUND OF THE INVENTION

Field of the Invention

The instant invention relates to a gas burner using a flame retaining nozzle for use in fabricating glass products and the like and more particularly to a burner utilizing a tabular alumina head that resists thermal shock.

Description of the Related Art

U.S. Pat. No. 3,697,000 issued to Giberson Jr. on Oct. 10, 1972 describes a gas burner for use with kilns, furnaces, and the like, having a tubular body with a venturi throat. A ceramic burner head of high-heat resistant material is mounted on one end of the body. A regulated volume of air, and gas are admitted at the opposite end.

A review of the prior art did not reveal a gas burner having flame retention capability together with a supplemental mixing chamber.

SUMMARY OF THE INVENTION

This invention discloses a gas mixing burner comprising a generally cup shaped cylindrical ceramic burner head made of tabular alumina supported in a cup shaped steel housing. The burner head having a cone shaped mixing chamber with a series of equal in number, radially and circumferentially spaced, angular and axial outlet ports together with a cylindrical flame reflecting ledge. Generated noise that is common to gas burners of this configuration is greatly reduced by having the exits of the outlets terminating in a radius. The angular outlet ports are equally spaced in a circular pattern and are at an angle of 60 degrees from the centerline of the burner and their exits are centered between the outlets of the axial ports and are at a greater distance from the burner centerline than the exits of the axial ports. The steel housing has an externally threaded entrance port opening into the ceramic mixing chamber.

DETAILED DESCRIPTION OF THE PREFERRED EMBODIMENT

Figure 1:
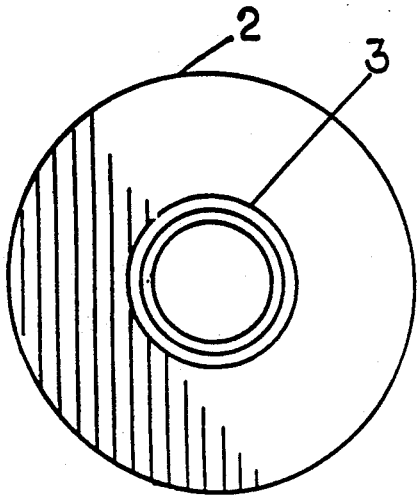
FIG. 1 is a left end view of the gas burner nozzle.
Figure 2:
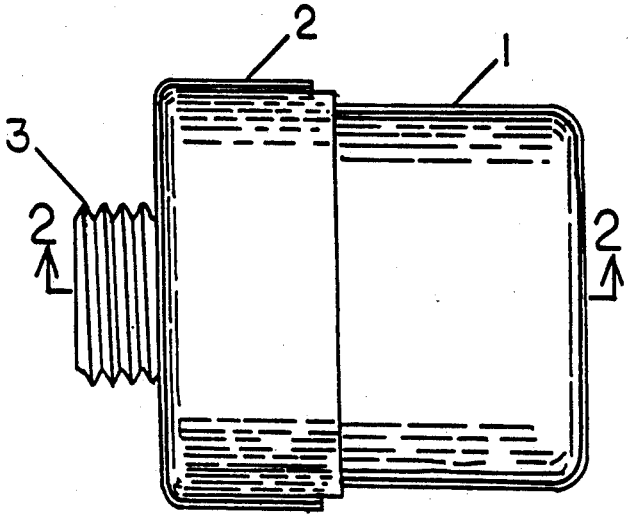
FIG. 2 is a side elevation of the gas burner nozzle, the opposite side being a mirror image thereof.
Figure 3:
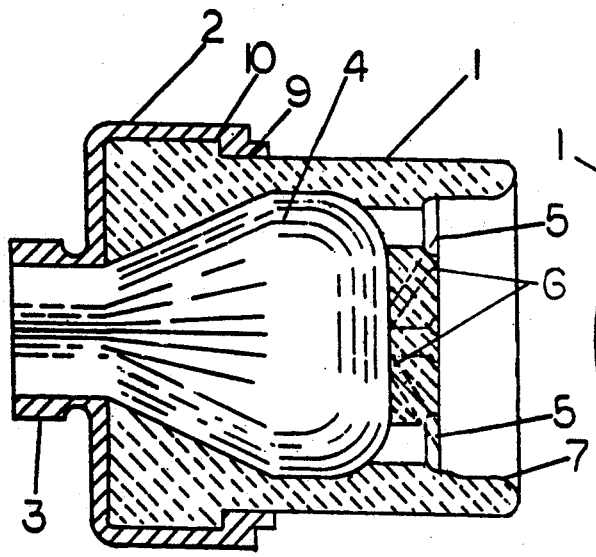
FIG. 3 is a sectional view through 2—2 of FIG. 2.
Figure 4:
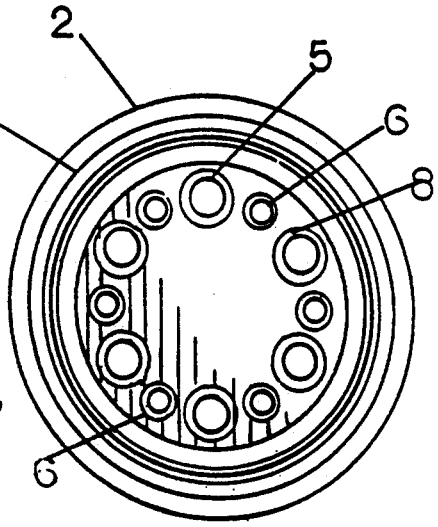
FIG. 4 is a right end view of the gas burner nozzle.

Referring to FIGS. 1, 2, 3, and 4, the formed steel cup 2 is shown with an externally threaded inlet 3 for the air and fuel. The ceramic mixing chamber 4 made from tabular alumina, which is a form of aluminum oxide, is shown with the axial exit ports 5 and the angular exit ports 6, the radial edges of the ports 8 and the flame retarding ledge 7. The outer edges of the steel cup 9 are of a reduced diameter so as to fit the circumferential ring 10 to securely retain the tabular alumina gas burner nozzle.

The instant invention provides a burner nozzle operable at higher temperatures and oxidation and with less noise compared to steel burners.

I claim:

1. A gas burner comprising:

a cup shaped gas burner nozzle made of tabular alumina having a cone shaped mixing chamber terminating at one end in an end wall portion;

said gas burner nozzle having a flame retarding circumferential ledge on said one end, extending outwardly from said end wall portion, the outer edge of said flame retarding ledge having a circular cross-section;

said end wall portion having a plurality of equally spaced axial outlet ports therethrough, said axial outlet ports being spaced in a circular pattern parallel to the axial centerline of the burner;

said end wall portion further having a plurality of angular outlet ports therethrough, said angular outlet ports being spaced in a circular pattern at an outward angle of approximately 60 degrees in a radial direction to the axial centerline of the burner, the centerline of each of the exits of said angular outlet ports being spaced radially outward from and circumferentially centered between the centerlines of the exits of adjacent axial outlet ports, each of said exits of said angular and axial outlet ports terminating an enlarged diameter concave-radiused edge; and, the other end of the burner nozzle being axially retained in a steel cup-shaped support member with an inlet aperture at the center thereof.

* * * * *